United States Patent [19]

Park

[11] Patent Number: 4,690,439

[45] Date of Patent: Sep. 1, 1987

[54] MECHANISM FOR OPENING AND CLOSING A DOOR OF A HOME ELECTRIC EQUIPMENT, PARTICULARLY A ELECTRONIC RANGE

[75] Inventor: Jong D. Park, Changwon, Rep. of Korea

[73] Assignee: Gold Star Co., Ltd., Seoul, Rep. of Korea

[21] Appl. No.: 866,368

[22] Filed: May 23, 1986

[30] Foreign Application Priority Data

May 24, 1985 [KR] Rep. of Korea ..... 6162/1985[U]

[51] Int. Cl.[4] ..... E05C 3/34

[52] U.S. Cl. ..... 292/27

[58] Field of Search ..... 292/27, 336.3, DIG. 69, 292/29, 30, 46, 53, 49, 124, 221

[56] References Cited

U.S. PATENT DOCUMENTS

| | | | |
|---|---|---|---|
| 1,766,366 | 6/1930 | Welch et al. | 292/29 X |
| 3,785,686 | 1/1974 | Armstrong | 292/336.3 |
| 4,365,490 | 12/1982 | Manzoni | 292/30 X |
| 4,457,545 | 7/1984 | Wilson et al. | 292/DIG. 69 X |

*Primary Examiner*—Richard E. Moore

*Attorney, Agent, or Firm*—Birch, Stewart, Kolasch & Birch

[57] ABSTRACT

A mechanism for opening and closing a door of a home electronic equipment which comprises a door hinged to a body and a door locking member pivotably mounted to the door thereof whereby only one action pulling a handle of the door makes the door locking member to be displaced into the unlocking position and simultaneously opens the door.

1 Claim, 3 Drawing Figures

MECHANISM FOR OPENING AND CLOSING A DOOR OF A HOME ELECTRIC EQUIPMENT, PARTICULARLY A ELECTRONIC RANGE

BACKGROUND OF THE INVENTION

The present invention relates to a mechanism for opening and closing a door of a home electric equipment, for example, an electronic range including a door hinged to a body thereof, and particularly to a mechanism for opening and closing a door wherein only one action pulling a handle of the door makes a door-locking means to be displaced into a lock-releasing position, and simultaneously makes the door to be opened.

Conventionally, such mechanism used doors of the above-mentioned home electric equipments comprises a handle attached to a front surface of a door to pull the door in the opening thereof, a door-locking means disposed in the interior of the door and adapted to lock the door on a body of the equipment at the closed position of the door, and a lock-releasing means adapted to release the lock of door when the door is to be opened. The lock-releasing means comprises, for example, a push button disposed on the outer surface of the door in order to be separately operated from the handle of the door. When the door associated with such conventional mechanism is to be opened, an operator has to push the push button, and simultaneously to pull the door handle. Accordingly, actual pulling force becomes higher than the force required to open the door. Furthermore, there is an inconvenience in opening the door, because the grip area of door handle and the direction pulling the handle are limited. In addition, the shape of the handle can not be various due to the construction of the above-mentioned mechanism.

SUMMARY OF THE INVENTION

Therefore, an object of the present invention is to provide a mechanism for opening and closing a door wherein one action pulling the handle of door makes the lock of door to be released, and simultaneously makes the door to be opened.

Other object of the present invention is to provide a mechanism for opening and closing a door, reducing the limitation of the grip area of door handle and the direction pulling the handle and enabling the door to be easily opened by a small force.

Another object of the present invention is to provide a mechanism for opening and closing a door, enabling the construction thereof to be simple as compared with the conventional mechanism and the handle to be variously designed.

In accordance with the present invention, these objects can be accomplished by providing a mechanism for opening and closing a door of a home electric equipment, particularly an electronic range, comprising: a pair of locking levers each pivotablely mounted, at the middle portion thereof, on the inner side wall of the door and provided, at one end thereof, with a locking portion having an engaging step and an inclined surface; a locking plate fixedly mounted on a front wall of a body of said electronic range and provided with a pair of openings each adapted to receive the corresponding locking portion of said locking lever and a pair of engaging extensions each adapted to engage with said engaging step of the locking lever so as to maintain the door at a locked position thereof when the door is closed; a pair of actuating levers each pivoted, at one end thereof, on the other end of said locking lever by means of a pin and provided, at the middle portion thereof, with a slot receiving a pin fixed on the inner side wall of the door and guiding the movement of said actuating lever, and provided with a lateral extension at a position between said slot and the pin connecting said locking lever and said actuating lever; a pair of springs arranged between respective lateral extension of said actuating levers and adapted to urge said actuating levers in a direction that each locking lever is maintained at a locking position thereof; a spring connector connecting said springs and having a protrusion; a circular cam pivoted on a pin fixed to the inner side wall of the door and adapted to effect the movement of said actuating lever by the pivoting movement thereof, said cam having at upper and lower positions thereof, a pair of cam surfaces each contacting with said other end of the actuating lever, respectively, and at the inner side thereof, an arc-shaped groove receiving said protrusion of the spring connector and respective steps formed at both ends of said groove, said steps adapted to limit the pivoting movement of the cam to a certain range by cooperating with said protrusion of the spring connector; and a T-shaped handle disposed outwardly from the outer wall of the door and integrally connected with said cam, so that said cam pivots together with said handle when the handle turns in either direction of clockwise or counter-clockwise, as an operator pulls the handle.

The present invention can be more fully understood from the following detailed description when taken in conjuction with the accompanying drawings.

BRIEF DESCRIPTION OF THE INVENTION

FIG. 1 is a perspective view of an electronic range applying a mechanism for opening and closing a door in accordance with the present invention; and FIGS. 2*a* and 2*b* are partial sectional views showing the construction and function of the mechanism in accordance with the present invention, wherein the FIG. 2*a* shows the condition when the door is closed, and the FIG. 2*b* shows the condition when the door is to be opened.

DETAILED DESCRIPTION OF THE PREFERRED EMBODIMENTS

Figure 1:
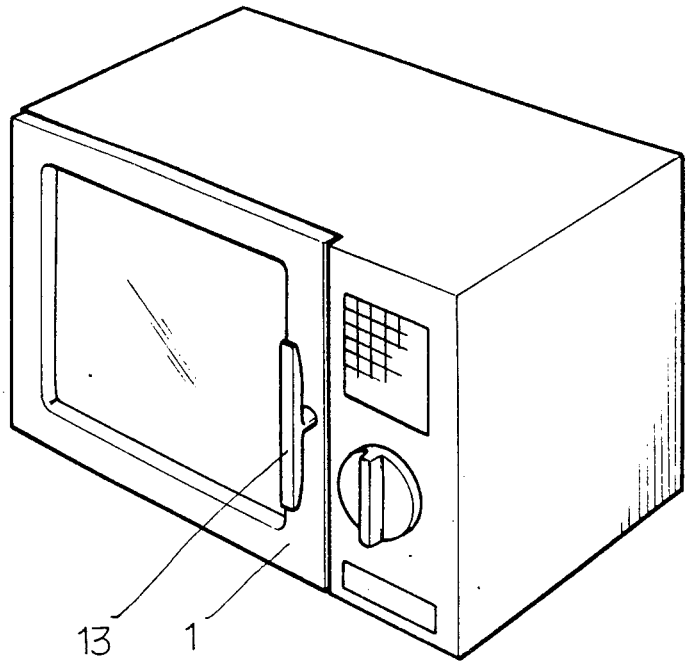
Figure 2A:
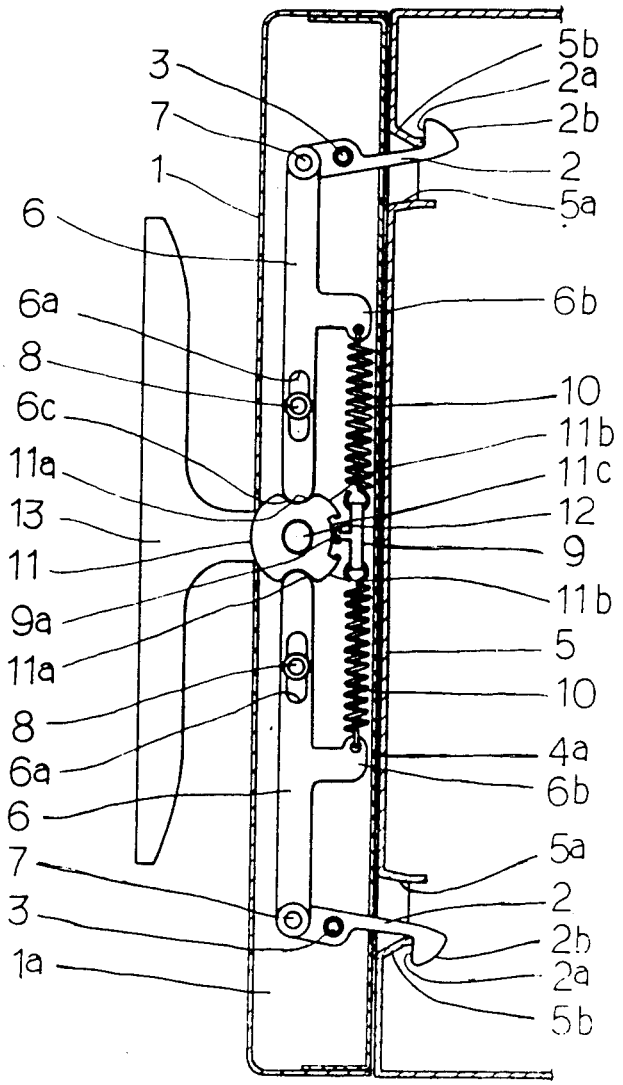
Figure 2B:
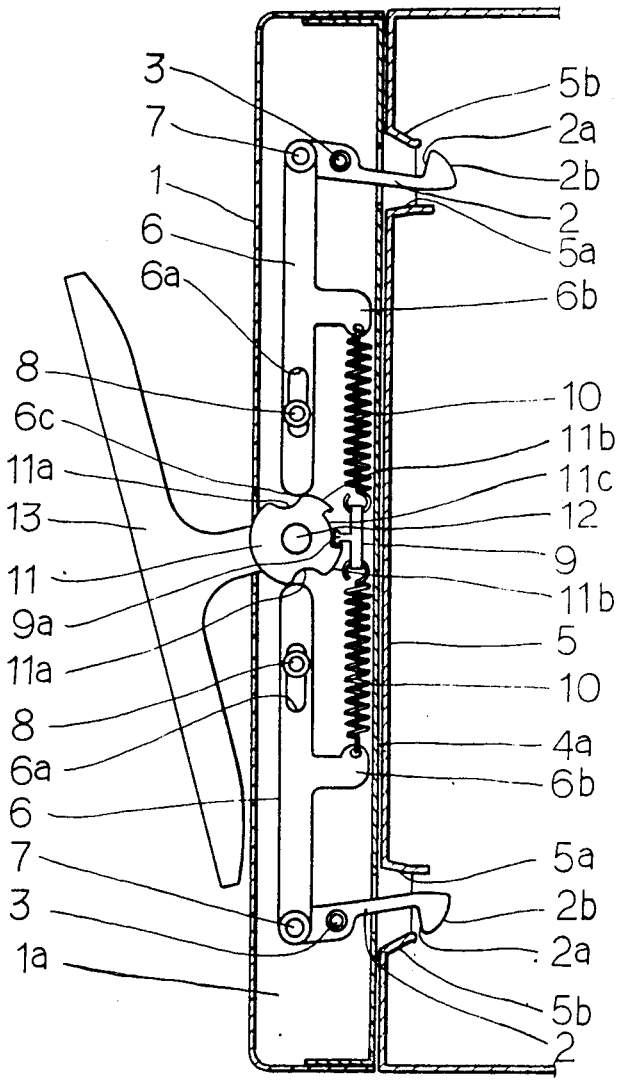

FIG. 1 shows an electronic range including a mechanism for opening and closing a door in accordance with the present invention. Referring to FIG. 2, the mechanism of the present invention has two same constructions arranged vertically on the inner side wall 1*a* of the opening-side end of door 1. The constructions are symmetrical with each other, so that the mechanism of the present invention will be described with reference to only one construction, particularly upper construction, in order to simplify the description thereof.

The mechanism of the present invention includes a locking lever 2 pivotablely mounted, at the middle portion thereof, on the inner side wall 1*a* of the opening-side end of door by means of a pin 3 fixed on said inner side wall. The locking lever 2 has, at one end, thereof a locking portion provided with an engaging step 2*a* and an inclined surface 2*b*. A locking plate 5 is fixedly mounted on a front wall of a body 4 of the electronic range and provided with an opening 5*a* adapted to receive the locking portion of the locking lever 2 and an engaging extension 5*b* adapted to engage with the engaging step 2*b* in order to maintain the door 1 at a locked position thereof when the door 1 is closed.

The mechanism of the present invention also includes an actuating lever 6 pivoted, at one end thereof, on the other end of the locking lever 2, that is, the opposite end to the end having locking portion, by means of a pin 7. The actuating lever 6 is provided, at the middle portion thereof, with a slot 6*a* receiving a pin 8 fixed on the inner side wall 1*a* of the door 1 and guiding the vertical movement of the actuating lever 6. The actuating lever 6 also has a lateral extension 6*b* disposed between the slot 6*a* and the end connected to the pin 7. The extension 6*b* of the actuating lever 6 has an end supporting one end of a spring 10 supported to a spring connector 9. The other end 6*c* of the actuating lever 6 has an arc-shaped surface contacting with a cam surface of a circular cam 11 as will be described hereinafter.

The spring 10 disposed between the extension 6*b* of the actuating lever 6 and the spring connector 9 functions to urge the actuating lever 6 in a direction that the locking lever 2 is maintained at a locking position thereof.

The mechanism of the present invention also includes the above-mentioned circular cam 11 pivoted on a pin 12 fixed to the inner side wall 1*a* of the door 1 and adapted to effect the vertical movement of the actuating lever 6 by the pivoting movement thereof. The cam 11 has, at upper and lower portions thereof, cam surfaces 11*a* each contacting with an arc-shaped surface of each actuating lever 6, respectively. The cam 11 also has, at the inner side thereof, an arc-shaped groove 11*c* receiving a protrusion 9*a* of the spring connector 9 and respective stops 11*b* formed at both ends of said groove 11*c* and adapted to limit the pivoting movement if the cam 11 to a certain range by cooperating with said protrusion 9*a* of the spring connector 9. The cam 11 is integrally connected, at the outer side thereof, with a T-shaped handle 13 disposed outwardly from the outer wall of the door 1, in order to pivot together with the handle 13 when the handle 13 is pivoted in a direction of clockwise or counter-clockwise, as an operator pulls upper or lower extension of the handle 13.

Now, the operation of the above-mentioned mechanism according to the present invention will be described in detail.

FIG. 2 shows a condition when the door 1 is closed. In this condition, the actuating lever 6 and the locking lever 2 are maintained at the locking positions thereof, respectively, by the spring force of the spring 10 disposed between the extension 6*b* of the actuating lever 6 and the spring connector 9. Accordingly, the engaging step 2*a* of the locking lever 2 engages with the engaging extension 5*b* of the locking plate 5, in order to lock the door 1.

When the door 1 has to be opened from the above-mentioned locked condition, an operator slightly pulls either upper or lower extension of the handle 13 to pivot the circular cam 11 fixed on the end of the handle 13 about the pin 12 in a direction of counter-clockwise or clockwise. As the cam 11 is pivoted about the pin 12, the cam surface 11*a* of the cam 11 pushes the end 6*c* of the actuating lever 6 in a direction away from the pin 12. Accordingly, the locking lever 2 connected to the actuating lever 6 is pivoted about the pin 3 in a direction of clockwise (in the case of upper construction), so that the engaging step 2*a* of the locking lever 2 moves to disengage from the engaging extension 5*b* of the locking plate 5. In this state, further pulling of the handle makes the door 1 to be opened.

In accordance with the present invention, the pulling of the handle is limited, by the cooperation of the stops 11*b* formed on the cam 11 and the extension 9*a* of the spring supporter 9, to a certain range preventing the extension ends of the handle 13 to contact with the front surface of the door 1. Therefore, there is no damage of the surface of the door caused by the pulling of the handle.

If the operater releases the pulling of the handle 13 when the door 1 is opened, the actuating lever 6 returns in a direction toward the pin 12, by the spring force of the spring 10. Simultaneouly, the actuating lever 6 pushes, at the end contacting with the cam 11, the cam surface 11*a* of said cam, so that the cam 11 pivots in a direction of clockwise (in the case of upper construction), thereby causing the handle 13 to return to the original position thereof.

On the other hand, when the door is closed from the above-mentioned condition, the locking end of the locking lever 2 is inserted into the opening 5*a* of the locking plate 5. During the inserting of the locking lever 2 into the locking plate 5, the inclined surface 2*b* is continuously contacted with the inner surface of the extension 5*b* of the locking plate until the engaging step 2*a* of the locking lever 2 engages with the extension 5*b* of the locking plate 5 to lock the door 1.

As can be understood from the above description, the mechanism of the present invention provides a convenience in opening the door, in that only one action pulling the handle makes the lock of the door to be released, and simultaneously makes the door to be easily opened.

What is claimed is:

1. A mechanism for opening and closing a door of a home electric equipment, particularly an electronic range, comprising:

a pair of locking levers each pivotablely mounted, at the middle portion thereof, on the inner side wall of the door and provided, at one end thereof, with a locking portion having an engaging step and an inclined surface;

a locking plate fixedly mounted on a front wall of a body of said electronic range and provided with a pair of openings each adapted to receive the corresponding locking portion of said locking lever and a pair of engaging extensions each adapted to engage with said engaging step of the locking lever so as to maintain the door at a locked position thereof when the door is closed;

a pair of actuating levers each pivoted, at one end thereof, on the other end of said locking lever by means of a pin and provided, at the middle portion thereof, with a slot receiving a pin fixed on the inner side wall of the door and guiding the movement of said actuating lever, and provided with a lateral extension at a position between said slot and the pin connecting said locking lever and said actuating lever;

a pair of springs arranged between respective lateral extension of said actuating levers and adapted to urge said actuating levers in a direction that each locking lever is maintained at a locking position thereof;

a spring connector connecting said springs and having a protrusion;

a circular cam pivoted on a pin fixed to the inner side wall of the door and adapted to effect the movement of said actuating levers by the pivoting movement thereof, said cam having, at upper and lower portions thereof, a pair of cam surfaces each contacting with said other end of the actuating lever, respectively, and at the inner side thereof, an arc-shaped groove receiving said protrusion of the spring connector and respective steps formed at both ends of said groove, said steps adapted to limit the pivoting movement of the cam to a certain range by cooperating with said protrusion of the spring connector; and a T-shaped handle disposed outwardly from the outer wall of the door and integrally connected with said cam, so that said cam pivots together with said handle when the handle turns in either direction of clockwise or counter-clockwise, as an operator pulls the handle.

* * * * *